US005934383A

United States Patent [19]

Jurgens et al.

[11] Patent Number: 5,934,383

[45] Date of Patent: Aug. 10, 1999

[54] STEERING DEVICE FOR STEERABLE DRILLING TOOL

[75] Inventors: Rainer Jurgens; Volker Krueger, both of Celle; Hans Jurgen Faber, Neustadt; Thomas Kruspe, Wienhausen, all of Germany

[73] Assignee: Baker Hughes Incorporated, Houston, Tex.

[21] Appl. No.: 08/870,338

[22] Filed: Jun. 6, 1997

[30] Foreign Application Priority Data

Jun. 7, 1996 [EP] European Pat. Off. ..... 96109136

[51] Int. Cl.[6] ..... E21B 7/04

[52] U.S. Cl. ..... 173/91; 175/26; 175/45; 175/61

[58] Field of Search ..... 173/91, 105; 175/26, 175/45, 61, 74, 320, 73

[56] References Cited

U.S. PATENT DOCUMENTS

| | | | |
|---|---|---|---|
| Re. 29,526 | 1/1978 | Jeter . | |
| 3,326,008 | 6/1967 | Baran et al. | 175/26 |
| 3,896,667 | 7/1975 | Jeter . | |
| 4,286,676 | 9/1981 | Nguyen et al. . | |
| 4,596,294 | 6/1986 | Russell . | |
| 4,834,196 | 5/1989 | Falgout, Sr. . | |
| 4,850,440 | 7/1989 | Smet . | |
| 4,895,214 | 1/1990 | Schoeffler . | |
| 4,899,834 | 2/1990 | Weldon | 175/73 |
| 5,078,218 | 1/1992 | Smet | 175/45 |
| 5,117,927 | 6/1992 | Askew . | |
| 5,168,943 | 12/1992 | Falgout, Sr. . | |
| 5,215,151 | 6/1993 | Smith et al. . | |
| 5,259,467 | 11/1993 | Schoeffler . | |
| 5,269,383 | 12/1993 | Forrest | 175/26 |
| 5,297,641 | 3/1994 | Falgout, Sr. . | |
| 5,311,952 | 5/1994 | Eddison et al. . | |
| 5,314,032 | 5/1994 | Pringle et al. . | |
| 5,333,686 | 8/1994 | Vaughan et al. | 175/45 |
| 5,368,111 | 11/1994 | Benoit et al. . | |
| 5,394,951 | 3/1995 | Pringle et al. | 175/26 |
| 5,419,405 | 5/1995 | Patton | 175/45 |
| 5,441,119 | 8/1995 | Head . | |
| 5,458,208 | 10/1995 | Clarke . | |
| 5,479,995 | 1/1996 | Falgout, Sr. . | |
| 5,485,889 | 1/1996 | Gray | 175/73 |
| 5,495,900 | 3/1996 | Falgout, Sr. . | |
| 5,503,235 | 4/1996 | Falgout, Sr. . | |
| 5,673,764 | 10/1997 | Falgout, Sr. . | |

FOREIGN PATENT DOCUMENTS

| | | |
|---|---|---|
| 0497405 | 8/1992 | European Pat. Off. . |
| 1268938 | 3/1972 | United Kingdom . |
| 80/02582 | 11/1980 | WIPO . |

*Primary Examiner*—Stephen F. Gerrity
*Attorney, Agent, or Firm*—Madan & Morris, PLLC

[57] ABSTRACT

The invention is a control device or directional drilling tool. The control device has an electromotor drive in the orienting device. The measuring and control device is situated between the orienting device and the drill string. Cable lead-throughs through the orienting device are eliminated. The electromotor drive of the orienting device can be actuated independently of drilling operations, making it possible to perform a rapid and precise performance of an orientation process while continuing drilling operations, reducing deviations from the planned drilling program.

35 Claims, 2 Drawing Sheets

STEERING DEVICE FOR STEERABLE DRILLING TOOL

CROSS REFERENCE TO RELATED APPLICATIONS

This application claims the benefit of the filing date of Patent Application No. 96109136.0 filed on Jun. 7, 1996 with the European Patent Office.

FIELD OF THE INVENTION

The invention relates to a control device for a directional drilling tool, particularly for drilling work with coiled tubing as the drilling tube.

BACKGROUND OF THE INVENTION

In the case of a known control device of this type (U.S. Pat. No. 5,311,952), the orientating device comprises a step switching mechanism which is driven by the drilling mud, the pressure of which is altered by reducing the pump pressure when it is necessary to actuate the step switching mechanism.

In the case of another known control device of the type mentioned at the outset (U.S. Pat. No. 5,215,151), the orientating device comprises a tubular differential piston which can be actuated by the drilling mud and which in the case of an axial displacement, is caused by a screw thread movement converting mechanism to produce a rotary movement and imparts a corresponding rotary movement to the second outer housing part which carries the directional drilling tool.

Another known control device (U.S. Pat. No. 5,339,913) describes two outer housing parts which are adapted to be telescopically extended and retracted in respect of each other, a screw thread movement converting transmission between the telescopic parts imparting a rotary movement to the outer housing part which carries the directional drilling tool.

Common to the prior art control devices is the fact that the measuring and controlling device is disposed underneath the orientating device.

If in the case of the previously known control devices there is a fresh orientation of the directional drilling tool, then essential operating parameters such as the pressure of the drilling mud or the weight loading of the drill bit which goes hand in hand with a variation in the twist of the coiled tubes will vary and upon resumption of drilling operation, there wilt be a furs variation. This means that in practice the process of orientation becomes time-consuming since it is subject to various interference variables which render prolonged testing inevitable.

SUMMARY OF THE INVENTION

The invention is concerned with the problem of providing a control device which makes it possible for the directional drilling tool to be orientated in a manner which is influenced by a few interference variables.

The control device according to the invention makes it possible with its electromotor drive of the orientating device which can be actuated independently of the drilling operation, to perform a rapid and precise performance of an orientation process in continued drilling operations, so avoiding alterations in the twist of the drill line.

The disposition of the measuring and control device in the first outer housing part between the orientating device and the drill pipe connecting part diminishes the frictional resistance of the extremely short second outer housing part considerably during orientation processes so that these operations can be carried out with high precision combined with minimal output expenditure. Furthermore, it avoids cable lead-throughs through the orientating device. If the drilling tool becomes jammed in the bore hole and if attempts to draw it up lead to break-off which usually occurs in the area between the first and second outer casing parts, then the expensive measuring and controlling device is still one of the solvable parts of the drill.

Further details and effects of the invention will emerge from the ensuing description of two examples of embodiment of the object of the invention which are shown in greater detail in the accompanying drawings, in which:

DETAILED DESCRIPTION OF THE INVENTION

Figure 1:
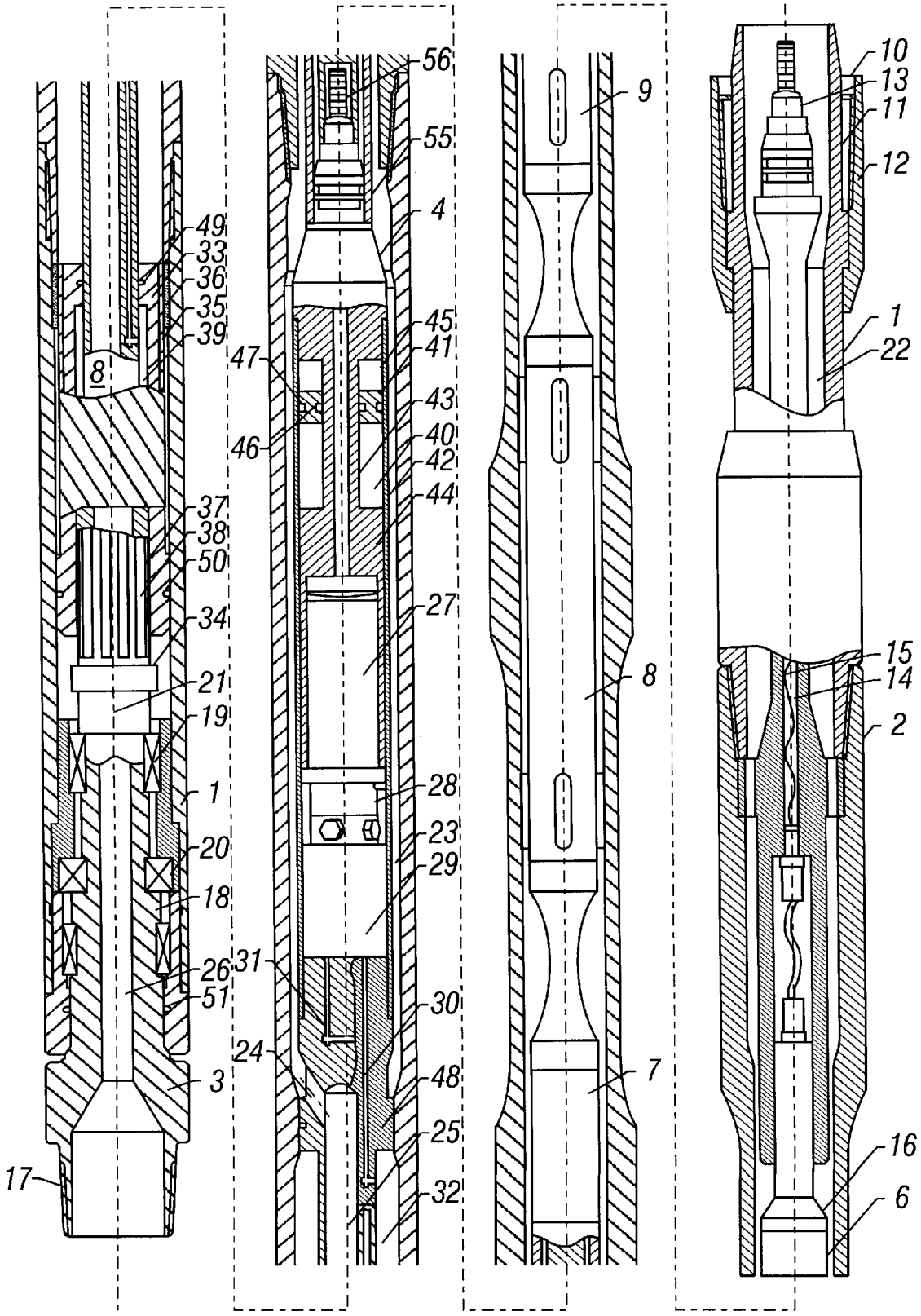
FIG. 1 is a diagrammatic simplified longitudinal section through a control device according to the invention.

The control device shown in FIG. 1 and which is intended for a directional drilling tool comprises in detail a tubular outer casing 1 which comprises a first outer casing part 2 which faces towards a drill pipe, not shown, and a second outer casing part 3 directly adjacent the outer casing part 2 and pointing towards a directional drilling tool, not shown. The outer casing 1 encloses an orientating (orienting) device generally designated 4 and a measuring and control device 6 which may comprise a measured value sensing part 7, an electronic measured value processing part 8 and an electronic control part 9 which may be accommodated separately but can also be accommodated jointly in a housing portion. Measuring and control devices of suitable construction are basically known and do not require any more detailed explanation here.

The first outer casing part 2 comprises a connecting part 10 for connection to a drill pipe, in the present instance a coiled pipe, comprising a hollow journal part 11 engaging the end of the pipe and, as the connecting means, a cap nut 12. The connection between control device and coiled pipe can be made without any prior orientation of the two parts. The torque is transmitted by frictional closure which is produced by the cap nut 12, The hollow journal part 11 thereby encloses an electrical quick-action connecting device 13 which is intended to establish an electrical connection of the measuring and control device 6 and an electrical conductor system accommodated in the coiled pipe. The electrical quick-action connecting device 13 is rotationally rigid, has a central passage 14 to accommodate electrical conductors 15 and has at its bottom end the stationary part of an electrical rotation transmitting device 16 of which the rotating part is associated with the top end of the measuring and control device 6.

The second outer casing part 3 comprises a connecting part 17 for example for a screwed connection to the outer casing of a directional drilling tool and comprises a shaft part 18 which is mounted in the first outer casing part 2 by means of bearings 19, 20 so that it can rotate about the longitudinal central axis 21 through the first outer casing part 2 and is operatively connected to the orientating device 4.

The first outer casing part 2 encloses the measuring and controlling device 6, leaving an annular gap 22 to allow the passage of drilling mud and which continues into an annular gap 23 surrounding the upper part of the orientating device 4. Via a transfer passage 24, the annular gap 23 is connected to a central drilling mud passage 25 in the bottom part of the orientating device 4, which merges into a corresponding central drilling mud passage 26 in the shaft part 18 of the second outer casing part 3.

As a drive source for positioning movements, the orientating device 4 comprises an electric motor 27 which, in operation, sets in motion an intermediate transmission which actuates the second outer casing part 3. The electric motor 27 is preferably constructed as a brushless three-phase alternating current motor which, in the case of the embodiment of control device according to FIG. 1, is constructed to be reversible in the direction of drive and it drives a hydraulic pump 28 which operates in reversing mode. Downstream of the outlet side of the hydraulic pump 28 there are control valves in a control valve assembly 29 and these determine the feed to hydraulic lines 30, 31.

The hydraulic line 30 opens out into an annular cylindrical space 32 bounded by the first outer casing part 2 and in which an annular positioning piston 33 is guided for axial displacement. The axial displacement of the positioning piston 33 can be converted by means of a screw thread guide into a rotary movement about the longitudinal central axis 21 of the first outer casing part 2, the said rotary movement being transmitted to a drive shaft 34 for the second outer casing part 3.

In detail, the positioning piston 33 has on its outer periphery helical guide grooves 35 engaged by sliding members 36 fixed on the inside of the first outer casing part and which, upon axial displacement of the positioning piston 33, imparts a rotary movement to this latter. Provided on the inner periphery of the positioning piston 33 is an axial multi-spline profile 37 which co-operates with corresponding axial grooves 38 on the outer periphery of the drive shaft 34.

When pressure is applied to the hydraulic line 30 and the hydraulic line 31 becomes pressureless, a downwards movement is imparted to the positioning movement 33 while the application of pressure to the hydraulic line 31, so that the hydraulic line 30 becomes pressureless, results in the positioning piston 33 perforating an upwards movement. The hydraulic line 31 is for this purpose guided along the drive shaft 34 as far as an inner annular space 39 in the positioning piston 33 and which is bounded on the inside by the drive shaft 34 which passes axially through the positioning piston 33.

Above the electric motor 27 there is an equalising chamber 40 bounded at the top by an equalising piston 41. The equalising or balancing chamber 40 is constructed as an annular chamber and is bounded on the outside by a tubular carrier housing 42 and on the inside by a tubular part 44' of a housing block 44 which accommodates the electric motor 27. This housing block 44 is enclosed by the carrier housing 42 which has above the equalising piston 41 ports which establish a connection between the equalising chamber 40 and the annular space 23 through which drilling mud flows.

Only for the sake of completeness is it pointed out that the equalising piston 41 is sealed in respect of the carrier housing 2 and the tubular part 43 of the housing block 44 by gaskets 46, 47 while the upper part of the drive shaft 34 is sealed in respect of the first outer casing part 3 by a gasket 48, the positioning piston 33 is sealed in respect of the drive shaft 34 by a gasket 49 and in respect of the first outer casing part 2 by a gasket 50 and the shaft part 18 of the second outer casing part 3 is sealed in respect of the first outer casing part 2 by a gasket 51.

In the region of its upper end part which is adjacent the control valve assembly 29, the drive shaft 34 is connected to the carrier housing 42 bracing this for co-rotation together with the parts connected to it so that the rotary movement transmitted from the positioning piston 33 to the drive shaft 34 during an orientation process is transmitted synchronously to the second outer casing part 3 and the directional drilling tool connected to it, but also to the main part of the orientating device 4 and the measuring and control device 6 connected to this latter. In spite of the disposition of the measuring and control device 6 above the orientating device 4, this ensures that the measuring and control device 6 is able to detect and evaluate the changes in position of the directional drilling tool as a result of an orientation process and is accordingly incorporated into the orientation process.

For electrically connecting the orientating device 4 and measuring and control device 6 there is a rapid connection device 55 which is disposed at the end of the housing block 44 and which, via the electrical contact part 56, establishes a supply of electricity to the electric motor 27 and the control valves in the control valve assembly 29.

After the performance of an orientation process, the positioning piston 33 can be hydraulically locked in whatever is its position at the time by means of the control valves in the control valve assembly 29. However, it is also conceivable to prevent a rotation of the drive shaft 34 and thus of the outer casing parts 2 and 3 in respect of each other by a braking or blocking device (not shown) which operates between the second outer casing part 3 and the drive shaft 34.

Figure 2:
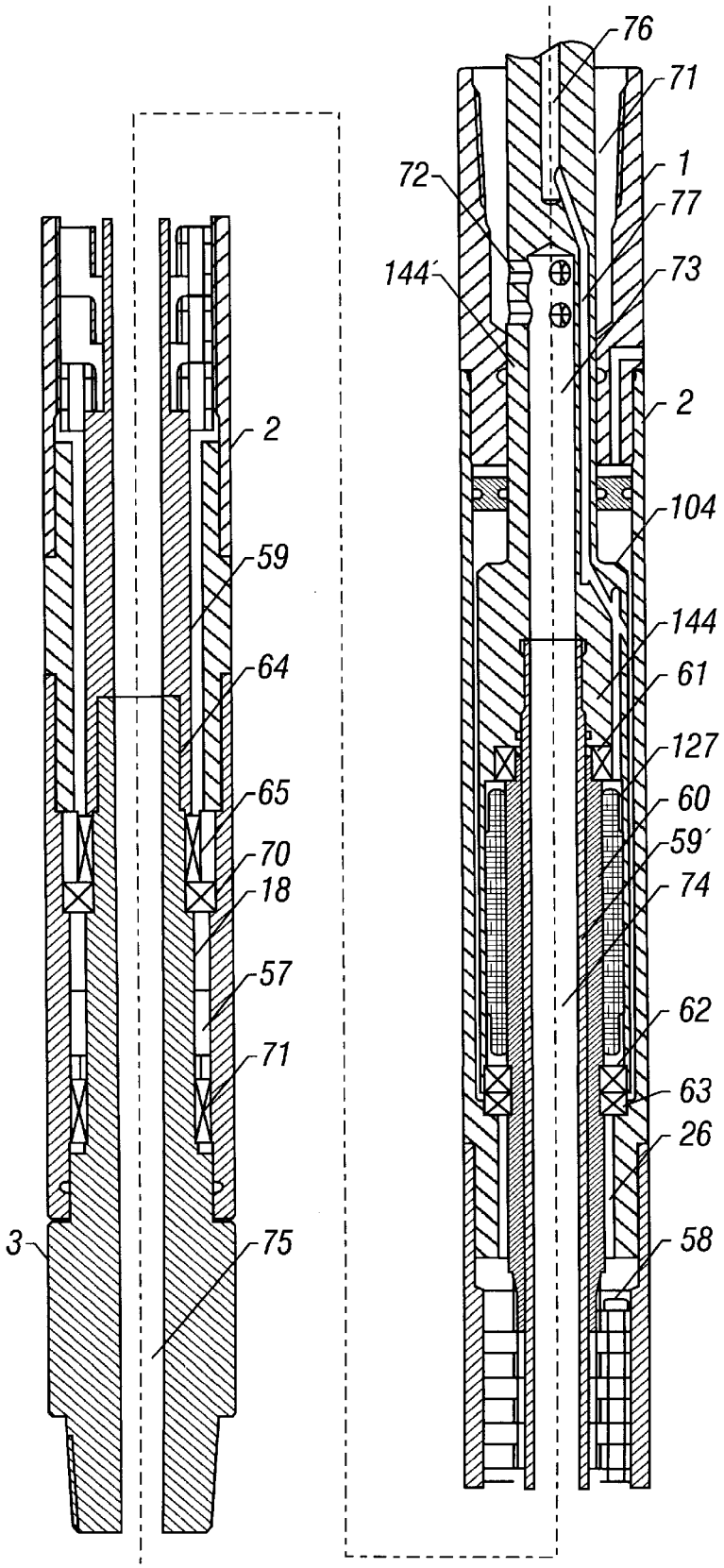
FIG. 2 shows a broken away sectional view similar to FIG. 1 of a second embodiment of control device according to the invention.

FIG. 2 illustrates a second embodiment of control device according to the invention in a view similar to that in FIG. 1 but broken away and showing the part of the first outer casing part 2 which accommodates the orienting device 104. As can be seen in FIG. 2, the orientating deice 104 comprises an electric motor 127, the drive shaft 26 of which acts upon a planetary gear mechanism 58 the output shaft 59 of which drives the being part 18 of the second outer casing part 3. Preferably, an eight-stage planetary gearing 58 is provided having a reduction ratio of for example 4400:1 which correspondingly reduces the rotary speed of the output shaft 59 of the electric motor 127 from for example 15 rpm to about 0.34 rpm.

In detail, the orientating device 104 comprises a housing block 144 of basically tubular form and supporting in bearings 61, 62 the winding 60 of the electric motor 127 as well as the rotor of the electric motor 127, which constitutes a hollow drive shaft 26, while being at the same time itself rotatably supported in the first outer casing part 2 by a bearing 63. The output shaft 59 of the planetary gearing 58 has, extending through the hollow drive shaft 26 of the electric motor 127, a part 59' which is connected above the electric motor 127 to the housing block 144. Accordingly, the housing block 144 is connected to the output shaft 59 in such a way as to be jointly rotatable. The output shaft 59 of the planetary gearing 58 is, at 64, connected, for example bolted, to the bearing part 18 of the second outer casing part 3 and is together with this bearing part 18 supported by bearings 65, 70 and 71 to be rotatable in respect of the first outer casing part 2. Between the bearing part 18 of the second outer housing part 3 and the first outer casing part 2 there is a clamping member freewheeling device 57 by which the reaction torque of the directional drilling tool is transmitted directly to the first outer casing part 2 and via this into the drill line so that the orientating device 104 which is adapted for unlimited rotation by the electric motor 127 is freed from the reaction torques of the directional drilling tool.

The housing block 144 comprises a part 144' which, at its end which is no longer illustrated, may be connected to a rapid connection device 55 of an embodiment according to FIG. 1, may carry the measuring and control device 6 and be electrically connected to this by a device corresponding to the electric rapid connecting device 55. In the part adjacent the measuring and control device 6, the part 144' is surrounded by an annular space 71 corresponding to the annular space 22 which communicates via ports 72 to a central drilling mud passage 73. The central drilling mud passage 73 in the part 144' of the housing block 144 has an extension 74 in the output shaft 59, 59' of the planetary gearing 58 and an extension 75 in the second outer casing part 3 so that the supply of drilling mud to the directional drilling tool is assured.

Also in the case of the embodiment according to FIG. 2, it is ensured that orientation processes can be undertaken independently of drilling operations by actuating the electric motor 127 and also here, despite the disposition of the measuring and control device 6 above the orientating device 104, it is ensured that the measuring and control device 6 performs synchronous rotary movements with the second outer casing part 3 which guides the directional drilling tool. In the case of this embodiment, the electric motor 127 can only be operated in one direction since the reversing mode is blocked by the clamping member freewheeling arrangement.

Basically, it must be noted that the parts 2 and 3 of the outer casing 1, the shafts 34 and 59 and basically all the tubular constituents of the control device may consist respectively of axially interconnected portions which are in particular bolted to one another, as is the rule in the case of tubular components of drilling appliances.

The part 144' of the housing block 144 comprises, in the direction of the measuring and control device 6, a central passage 76 which extends in an eccentric passage 77 which extends down into the region of the winding 60 of the electric motor 127 and serves to accommodate the electric motor 127 together with conductors which electrically connect the measuring and control device 6.

The embodiments of control device according to the invention which are illustrated in FIGS. 1 and 2 combine within them the advantages of a rapid and precise completion of the orientation process while the drilling operations continue and those advantages which result from disposing the measuring and control device 6 above the orientating device. However, in any embodiment whatsoever of orientating device, the measuring and control device 6 can be disposed above it in the first casing part, for example those orientating devices such as are known in the state of the art and which were described in the preamble.

We claim:

1. A control device for controlling the orientation of a directional drilling tool, the control device adapted to be coupled to a drilling tubular; comprising:

(a) a first casing:

(b) an orienting device carried by said first casing, said orienting device including an electric motor and an intermediate transmission actuated by said motor, and (c) a second casing disposed downhole of the first casing for rotating the directional drilling tool, said second casing coupled to and rotatable relative to the first casing upon actuation of the intermediate transmission by said electric motor.

2. The control device of claim 1, wherein the electric motor is constructed as a brushless three-phase alternating current motor.

3. The control device of claim 2 wherein the electric motor further comprises a rotor with an inner hollow drive shaft.

4. The control device of claim 2, the intermediate transmission further comprising:

(a) a hydraulic pump operable by the electric motor in a reversible mode; and (b) a hydraulic positioning piston adapted to be actuated by the hydraulic pump, the hydraulic positioning piston capable of imparting a rotary drive to a bearing on the second casing by a screw thread guide.

5. The control device of claim 4, further comprising:

(a) a coaxial drive shaft for the second casing, and (b) a connecting mechanism coupled to the positioning piston and the coaxial drive shaft for imparting motion of the positioning piston to the coaxial drive shaft;

the screw thread guide being between the first casing portion and the positioning piston.

6. The control device of claim 5, further comprising a measuring and control device disposed above the orienting device, and wherein the measuring and control rotates in synchronism with the second casing.

7. The control device of claim 6, further comprising a tubular carrier housing that accommodates the electric motor, the hydraulic pump and the control valve assembly, said tubular carrier housing being supported by the drive shaft.

8. The control device of claim 4, wherein the control device has in the region of its end remote from the orienting device an electrical rotation transmitting device for an electrical connection to the non-rotatably supported part of an electrical rapid-action connecting device.

9. The control device of claim 8, further comprising (a) a connection part for coupling the first casing to the drilling tubular, said connection part including a guide part engaging around the contact part of the electrical rapid-action connecting device; and (b) a cap nut for attaching the connection part to the tubing.

10. The control device of claim 1, the intermediate transmission further comprising:

(a) a hydraulic pump operable by the electric motor in a reversible mode; and (b) a hydraulic positioning piston adapted to be actuated by the hydraulic pump, the hydraulic positioning piston capable of imparting a rotary drive to a bearing on the second casing by a screw thread guide.

11. The control device of claim 10, further comprising:

(a) a coaxial drive shaft for the second casing, and (b) a connecting mechanism coupled to the positioning piston and the coaxial drive shaft for imparting motion of the positioning piston to the coaxial drive shaft;

the screw thread guide being between the first casing portion and the positioning piston.

12. The control device of claim 11, further comprising a measuring and control device disposed above the orienting device, and wherein the measuring and control rotates in synchronism with the second casing.

13. The control device of claim 12, further comprising a tubular carrier housing that accommodates the electric motor, the hydraulic pump and the control valve assembly, said tubular carrier housing being supported by the drive shaft.

14. The control device of claim 13, wherein the orienting device is electrically connected to the measuring and control device via an electrical quick-action connecting device.

15. The control device of claim 12, wherein the orienting device is electrically connected to the measuring and control device via an electrical quick-action connecting device.

16. The control device of claim 10, wherein the positioning piston can be hydraulically locked in any position between a first and second extreme positions by means of the control valves.

17. The control device of claim 10, wherein the control device and the upper part of the orienting device define with the first casing portion an annular space through which drilling mud is able to flow.

18. The control device of claim 17, wherein the drive shaft and the second casing portion jointly bound a central drilling mud passage which, via a connecting passage in the upper end of the drive shaft, communicates with the annular space in the outer casing part.

19. The control device of claim 10, wherein the control device has in the region of its end remote from the orienting device an electrical rotation transmitting device for an electrical connection to the non-rotatably supported part of an electrical rapid-action connecting device.

20. The control device of claim 19, further comprising (a) a connection part for coupling the first casing to the drilling tubular, said connection part including a guide part engaging around the contact part of the electrical rapid-action connecting device; and (b) a cap nut for attaching the connection part to the tubing.

21. The control device of claim 1, wherein the electric motor has a drive shaft operatively coupled to a multi-stage planetary gear mechanism, the multi-stage planetary gear mechanism having an output shaft driving the second casing.

22. The control device of claim 21, wherein the output shaft of the planetary gearing comprises a extension part which extends through the drive shaft of the electric motor and the electric motor.

23. The control device of claim 22, wherein the output shaft of the planetary gearing and the second outer casing part jointly bound a central drilling mud passage.

24. The control device of claim 23, further comprising a clamping member freewheeling mechanism associated with a bearing part of the second casing for transmitting the reaction moment of the directional drilling tool to the first casing.

25. The control device of claim 22, further comprising a clamping member freewheeling mechanism associated with a bearing on the second casing for transmitting the reaction moment of the directional drilling tool to the first casing.

26. The control device of claim 21, wherein an extension drives a measuring and control device in the first casing via the orienting device in synchronism with the second casing.

27. The control device of claim 26, further comprising a clamping member freewheeling mechanism associated with a bearing part of the second casing for transmitting the reaction moment of the directional drilling tool to the first casing.

28. The control device of claim 21, wherein the orienting device further comprises a tubular housing block which is mounted for coaxial rotation in the first casing and which supports a winding of the electric motor.

29. The control device of claim 28, wherein the control device is rotationally rigidly supported on the housing block of the orienting device.

30. The control device of claim 28, wherein the output shaft of the planetary gearing is coupled to the housing block of the orienting device in an area above the winding of the electric motor.

31. The control device of claim 21, further comprising a clamping member freewheeling mechanism associated with a bearing on the second casing for transmitting the reaction moment of the directional drilling tool to the first casing.

32. The control device of claim 1, wherein the control device has in the region of its end remote from the orienting device an electrical rotation transmitting device for an electrical connection to the non-rotatably supported part of an electrical rapid-action connecting device.

33. The control device of claim 32, further comprising (a) a connection part for coupling the first casing to the drilling tubular, said connection part including a guide part engaging around the contact part of the electrical rapid-action connecting device; and (b) a cap nut for attaching the connection part to the tubing.

34. A method of controlling the orientation of a directional drilling tool, the control device adapted to be coupled to a drilling tubular; comprising:

(a) coupling a first casing of a control device to the drilling tubular;

(b) coupling a second casing of the control device, said second casing disposed downhole of the first casing, to the directional drilling tool; and (c) using an electric motor on an orienting device carried by the first casing to actuate an intermediate transmission in the orienting device, thereby causing the intermediate transmission to rotate the second casing relative to the first casing.

35. The method of claim 34, further comprising coupling a drive shaft of the electric motor to a multi-stage planetary gear mechanism, and using an output shaft of the multi-stage planetary gear mechanism to rotate the second casing.

* * * * *